US011193742B2

(12) United States Patent
Ng et al.

(10) Patent No.: US 11,193,742 B2
(45) Date of Patent: Dec. 7, 2021

(54) DOOR BREACHING PROJECTILE

(71) Applicant: ADVANCED MATERIAL ENGINEERING PTE LTD, Singapore (SG)

(72) Inventors: Su Shan Ng, Singapore (SG); Yuen Hoong Benedict Woo, Singapore (SG); Juan Kiat Quek, Singapore (SG); Cheng Hok Aw, Singapore (SG)

( * ) Notice: Subject to any disclaimer, the term of this patent is extended or adjusted under 35 U.S.C. 154(b) by 0 days.

(21) Appl. No.: 16/967,146

(22) PCT Filed: Jan. 31, 2019

(86) PCT No.: PCT/SG2019/050055

§ 371 (c)(1),
(2) Date: Aug. 4, 2020

(87) PCT Pub. No.: WO2019/151949

PCT Pub. Date: Aug. 8, 2019

(65) Prior Publication Data

US 2020/0355478 A1 Nov. 12, 2020

(30) Foreign Application Priority Data

Feb. 5, 2018 (SG) ..... 10201800998X

(51) Int. Cl.
*F42B 12/20* (2006.01)
*F42B 27/00* (2006.01)
(Continued)

(52) U.S. Cl.
CPC ..... *F42B 12/204* (2013.01); *F42B 27/00* (2013.01); *F42C 1/04* (2013.01); *F42C 1/08* (2013.01); *F42C 15/184* (2013.01)

(58) Field of Classification Search
CPC ..... F42B 12/204; F42B 27/00; F42C 1/04; F42C 1/08; F42C 15/184
(Continued)

(56) References Cited

U.S. PATENT DOCUMENTS 3,269,311 A 8/1966 Comerford
8,800,448 B2 * 8/2014 Frew ..... F42B 12/74 102/394

(Continued)

FOREIGN PATENT DOCUMENTS

WO 00/52415 A1 9/2000

OTHER PUBLICATIONS

ISR; Intellectual Property Office of Singapore; dated May 14, 2019.

*Primary Examiner* — John Cooper
(74) *Attorney, Agent, or Firm* — Patshegen IP LLC; Moshe Pinchas

(57) ABSTRACT

This invention describes embodiments of door breaching grenades (100,100*a*,100*b*,100*c*,100*d*). Each grenade comprises a projectile (101,101*a*,101*b*,101*c*,101*d*) coupled to a propulsion cartridge (105); each projectile comprises a shell (110), a body member (140) and an ogive (180). A safe-and-arm mechanism (150) is located in the body member. A seat member (160) and a plunger (166) are assembled on a forward face of the body member so that a leading end of the plunger is in contact with an inside tip surface of the ogive, or a hollow guide member (184) is integrally formed with an inside tip surface of the ogive. In the armed state, upon impacting on a door/barricade (5), the plunger or hollow guide/sleeve impinges on a detonator pin (164), which then sets off a chain of explosive charges (152, 120, 122) whilst the projectile is still outside the door/barricade. The grenade is made substantially of polymer parts.

10 Claims, 7 Drawing Sheets

(51) Int. Cl.
*F42C 1/04* (2006.01)
*F42C 1/08* (2006.01)
*F42C 15/184* (2006.01)

(58) Field of Classification Search
USPC ..... 102/482
See application file for complete search history.

(56) References Cited

U.S. PATENT DOCUMENTS

| | | | | |
|---|---|---|---|---|
| 9,982,978 | B2 * | 5/2018 | Teper | F42B 12/204 |
| 2011/0174187 | A1 * | 7/2011 | Van Stratum | F42B 30/04<br>102/464 |
| 2012/0180688 | A1 | 7/2012 | Padgett | |
| 2012/0216698 | A1 * | 8/2012 | Van Stratum | F42C 1/14<br>102/439 |
| 2020/0355478 | A1 * | 11/2020 | Ng | F42C 1/08 |

* cited by examiner

DOOR BREACHING PROJECTILE

FIELD OF INVENTION

The present invention relates to a door breaching projectile. In particular, the projectile relates to 40 mm grenades which are non-fragmenting and programmed for short arming distance.

BACKGROUND

Conventional launcher-fired 40 mm projectiles or grenades are designed with fragmenting bodies. For engagement in urban environment, low-velocity variants of these grenades are fired at shorter distances to breach doors, shutters, windows, gates, barricades and so on; desirably, these door-breaching projectiles are non-fragmenting, ie. generates little hazardous fragments or shrapnel upon explosion (both to the launcher and any occupants behind the door, shutter, window, etc.).

U.S. Pat. No. 8,413,586, assigned to Chemring Ordnance, Inc., describes a 40 mm door breaching projectile, as shown in FIG. 1A. This projectile uses a forward extending stand-off device, which detonates an explosive charge before the nose of the projectile actually strikes the door. Thus, early detonation produces pressure waves against the door exterior which force the door to open inwardly. Shrapnel produced by the detonation of the projectile remains outside the door.

In another approach, U.S. Pat. No. 9,389,053, assigned to Nammo Talley, Inc., describes another 40 mm door breaching projectile. This projectile is made of a composite housing, filled with an insensitive explosive and designed for point detonating (PD).

Despite development of the above projectiles, there is a need to provide a new type of 40 mm projectile for breaching doors and barricades in urban military or law enforcement.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention seeks to provide a new type of 40 mm projectile or grenade for breaching doors or barricades during urban law enforcement.

In one embodiment, the present invention provides a door breaching projectile. The door breaching projectile comprising: a shell containing an explosive charge; a mouth at an open end of the shell being connected to a rear edge of a body member; a mouth of a hollow ogive being connected to a forward edge of the body member; a safe-and-arm mechanism disposed in the body member, which safe-and-arm mechanism delays alignment of a detonator pin with a detonator charge only after the door breaching projectile has been propelled over a safe distance from the launcher and has spin rotated through predetermined numbers of spin; and a plunger slidable in a seat member, which assembly is mounted on a forward face associated with the forward edge of the body member; so that, upon the door breaching projectile impacting on a door or barricade, the plunger is forced into the seat member to impinge onto the detonator pin, which then sets off the detonator charge and explosive charge, such that explosive shock waves cause the door/barricade to cave in but the projectile remains substantially outside the door/barricade.

Preferably, the door breaching projectile further comprises a sleeve. The sleeve is being received in the seat member so that the plunger is slidable inside the sleeve under influence of an impacting force.

Preferably, a leading end of the plunger contacts an inside surface of the ogive near a forward tip. It is also possible that the leading end of the plunger sits in a collar formed on the inside surface of the ogive. It is also possible that the leading end of the plunger sits inside a hollow guide member which is integrally formed to extend from an inside tip surface of the ogive. It is possible that the hollow guide member is dimensioned with outside and inside diameters that are substantially similar to respective outside and inside diameters of the sleeve, with the hollow guide member and sleeve being longitudinally aligned but dispenses with the plunger. In another possibility, the leading end of the plunger is formed with a mushroom head.

Preferably, the shell, body member, ogive, plunger and seat member are made from a polymer or polymers.

In another embodiment, the present invention provides a door breaching grenade. The door breaching grenade comprises the above projectile being coupled to a propulsion cartridge.

In yet another embodiment, the present invention provides a method for breaching a door/barricade from a distance. The method comprising: launching a projectile from a grenade launcher to impact on the door/barricade; after the projectile is armed, delay rotating a safe-and-arm mechanism so that a detonator charge is aligned with a detonator pin fitted in a seat member, which seat member is mounted on a forward face of a body member; and upon the projectile impacting on the door/barricade, causing impact force on the door/barricade to impinge on the detonator pin to set off both the detonator charge and an explosive charge disposed aft of the body member, so that explosive shock waves cause the door/barricade to cave in whilst the projectile remains substantially outside the door/barricade.

BRIEF DESCRIPTION OF THE DRAWINGS

This invention will be described by way of non-limiting embodiments of the present invention, with reference to the accompanying drawings, in which.

DETAILED DESCRIPTION

Figure 1A:
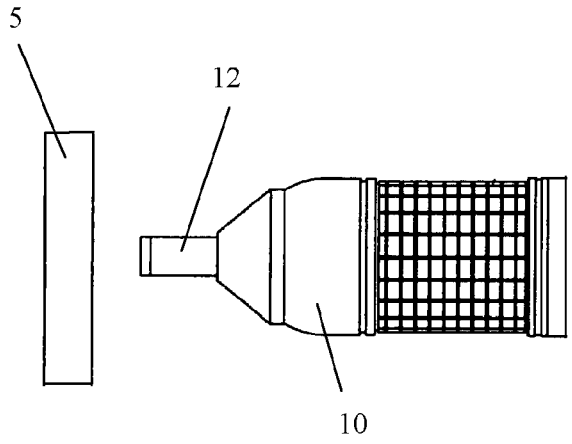
FIG. 1A (Prior Art)
FIG. 1A illustrates a known door breaching projectile which employs a forward extending stand-off contactor.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

FIG. 1A shows a known 40 mm door breaching projectile 10. This door breaching projectile 10 employs a forward extending contactor 12, such that a detonator 14 is activated before the ogive 16 strikes a door or barricade 5. As a result, an explosive charge 18 inside the door breaching projectile 10 is activated on an exterior of the door or barricade. Thus, the door 5 bears a substantial portion of the explosive forces, and any shrapnel created by the exploding breaching projectile remains substantially outside the door or barricade and any potential injury to occupants behind the door is limited.

Figure 1B:
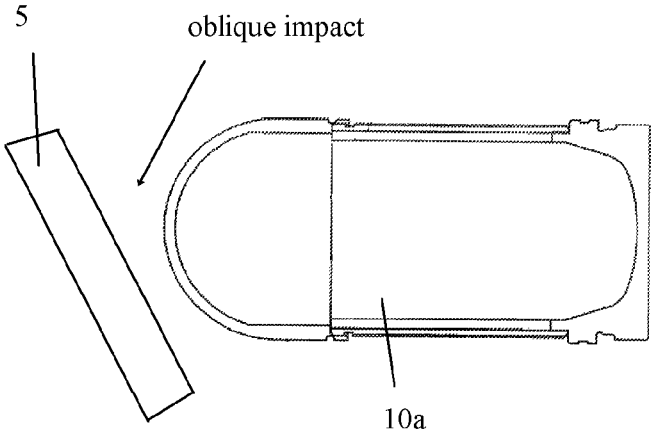
FIG. 1B (Prior Art)
FIG. 1B illustrates a breaching projectile striking a door at an oblique angle in a non-point detonating mode.

FIG. 1B shows a breaching projectile 10*a* being propelled at an oblique angle at a door or barricade 5, which is often the case in real life. In this non-point detonating impact, any forward extending contactor like the one described above would negate the purpose of providing the shaped ogive; hence, there is a need to provide another type of door breaching projectile and grenade.

Figure 2A:
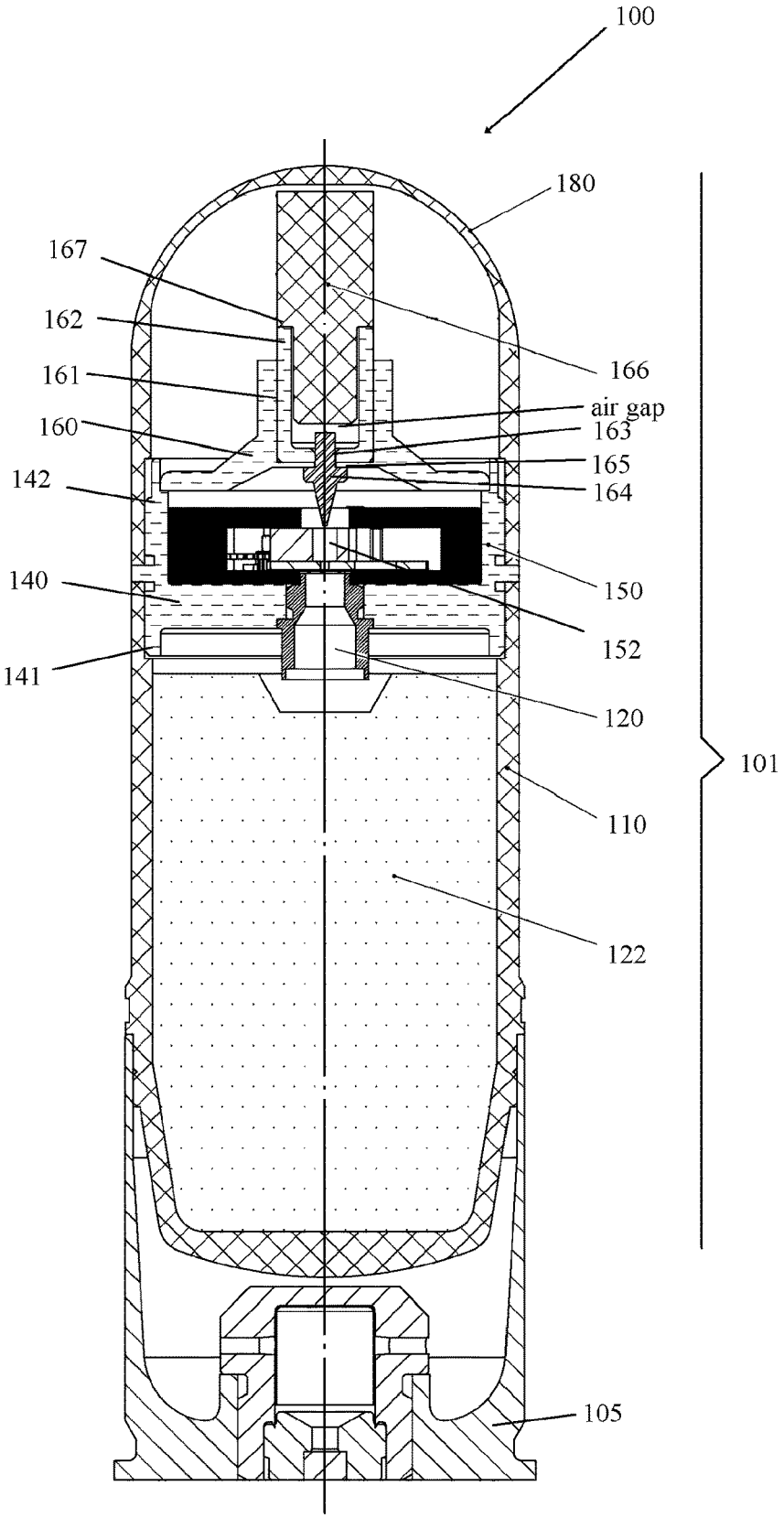
FIG. 2A illustrates a door breaching projectile/grenade according to an embodiment of the present invention, in which a safe-and-arm inertial fuze assembly is located forward of a booster or explosive charge.

FIG. 2A shows a door breaching grenade 100 according to an embodiment of the present invention. In the following description, the door breaching grenade 100 is made up of a projectile 101 coupled to a propulsion cartridge 105. This door breaching grenade 100 differs from a conventional grenade in that: (1) the ogive portion is relatively longer or the head of the projectile is relatively longer; (2) the safe-and-arm mechanism is located forward of the booster or explosive charge in the projectile; (3) the projectile is substantially made from a polymer, which does not fragmentate into shrapnel; and (4) the safe-and-arm mechanism is tuned for relatively short fuzing.

As shown in FIG. 2A, the door breaching projectile 101 is made up of a shell 110, a body member 140 and a hollow ogive 180. An open end of the shell 110 is connected to a rear edge 141 of the body member 140, whilst the hollow ogive 180 is connected to a forward edge 142 of the body member 140. Housed inside the body member 140 is a safe-and-arm mechanism 150, which allows the door breaching projectile 101 to be armed only after the projectile 101 has been propelled to a safe distance away from the launcher and has spin rotated a predetermined number of turns. A seat member 160 is mounted on a forward face 142*a* that is associated with the forward edge 142. The seat member 160 has a centre hole 161, which is coaxial with a longitudinal axis of the door breaching projectile 101. The seat member 160 is shaped like a stool with a wide base seated in contact with the forward face 142*a*, as seen in FIG. 2A. Disposed coaxially in the centre hole 161 of the seat member 160 is a cylindrical sleeve 162. A closed end of the sleeve 162 has a through-aperture 163, through which is fitted a detonator pin 164. The detonator pin 164 has a shoulder 165 and the shoulder 165 is located below the sleeve 162 such that the detonator pin 164 is slidable in a rearward direction with respect to the forward propulsion of the door breaching projectile 101. One end of a plunger 166 is fitted inside the sleeve 162 such that there is an air gap between the plunger 166 and the detonator pin 164, whilst the opposite end of the plunger 166 is in contact with an inside surface of the ogive 180 near the forward tip. The fit between the plunger 166 and the sleeve 162 allows sliding of the plunger 166; to fix this non-activated position of the plunger 166 inside the sleeve 162, a shoulder 167 is provided on the plunger 166.

Now, referring again to FIG. 2A, a booster charge 120 is disposed at a rear face 141*a* associated with the rear edge 141 of the body member 140, such that when the door breaching projectile 101 is armed, the detonator pin 164 is aligned with a detonator charge 152 mounted on the safe-and-arm mechanism 150, and the detonator charge 152 is also aligned with the booster charge 120. An inside cavity of the shell 110 rearward of the safe-and-arm mechanism 150 is filled and compacted with a predetermined amount of explosive charge 122. In use, when the booster charge 120 is ignited by the detonator charge 152 as the door breaching projectile 101 impacts on an exterior of a door/barricade 5, the explosive charge 122 is set off and shock waves from explosion of the explosive charge 122 force the door/barricade 5 to cave in, whilst the projectile 101 is still substantially outside the door/barricade. Further, as the shell 110, body member 140, ogive 180, seat member 160, sleeve 162 and plunger 166 are made from an engineering polymer or various types of polymers, this/these polymer(s) does/do not disintegrate into small pieces and there is substantially little shrapnel created by explosion of the explosive charge 122. Further, as the safe-and-arm mechanism 150 is located forward of the explosive charge 122, limited amounts of disintegrated parts, if any, from the safe-and-arm mechanism are thrown back in the direction of the launcher.

Figure 2B:
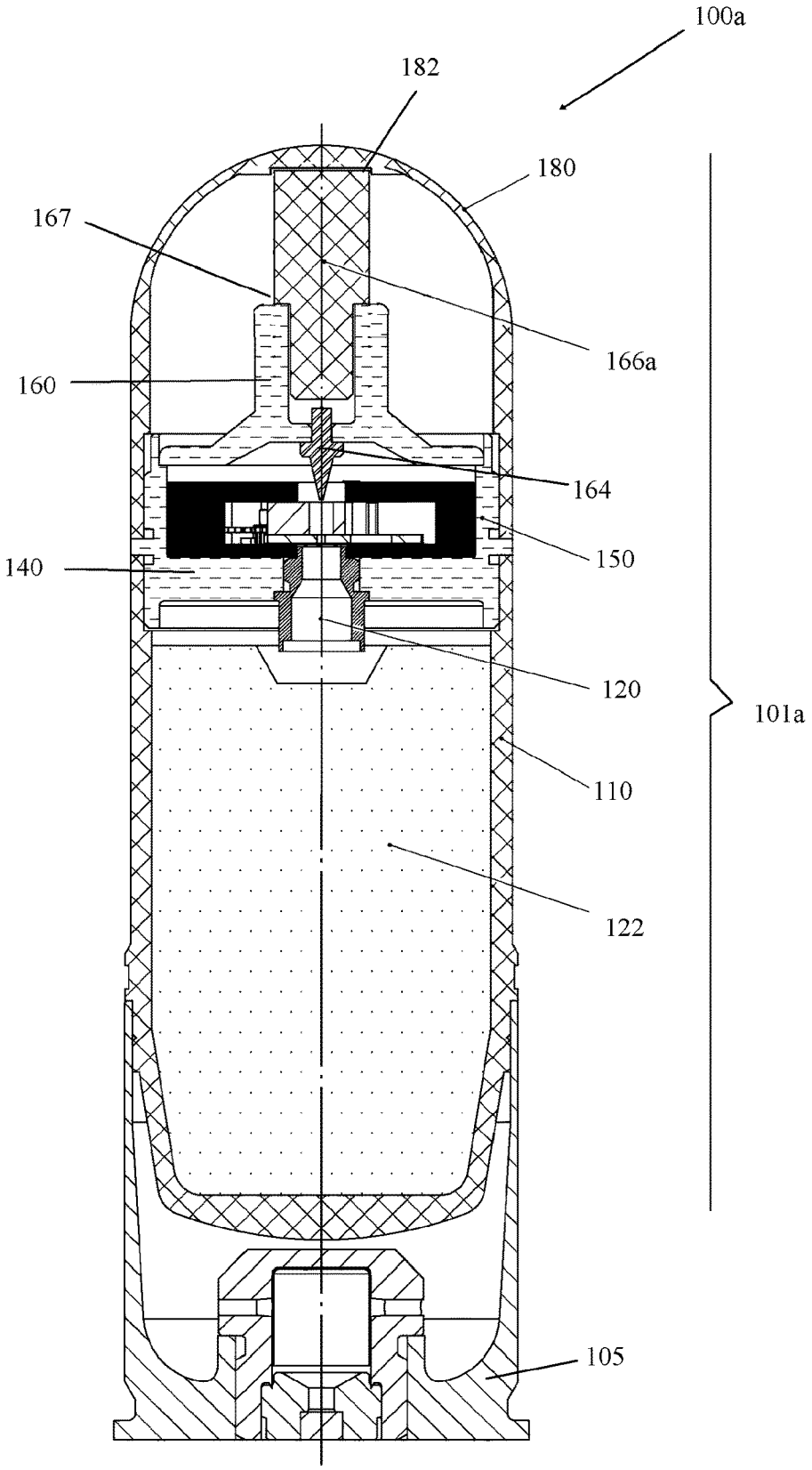
FIG. 2B illustrates a door breaching projectile/grenade according to a variation of the projectile shown in FIG. 2A.

FIG. 2B shows a door breaching grenade 100*a* according to another embodiment of the present invention. The door breaching grenade 100*a* shown in FIG. 2B is similar to that shown in FIG. 2A except that the sleeve is now integrally formed with the seat member 160 and the leading end of the plunger 166*a* is located in a collar 182 formed on the inside surface of the ogive 180. The collar 182 is provided so that when the door breaching projectile 101*a* impacts onto a door/barricade 5 at an oblique angle, a component of the impact force at the ogive is transferred effectively to the plunger 166*a* and urges the plunger 166*a* to slide into the seat member 160, thereby, to actuate the detonator pin 164 and to set off the detonator, booster and explosive charges.

Figure 2C:
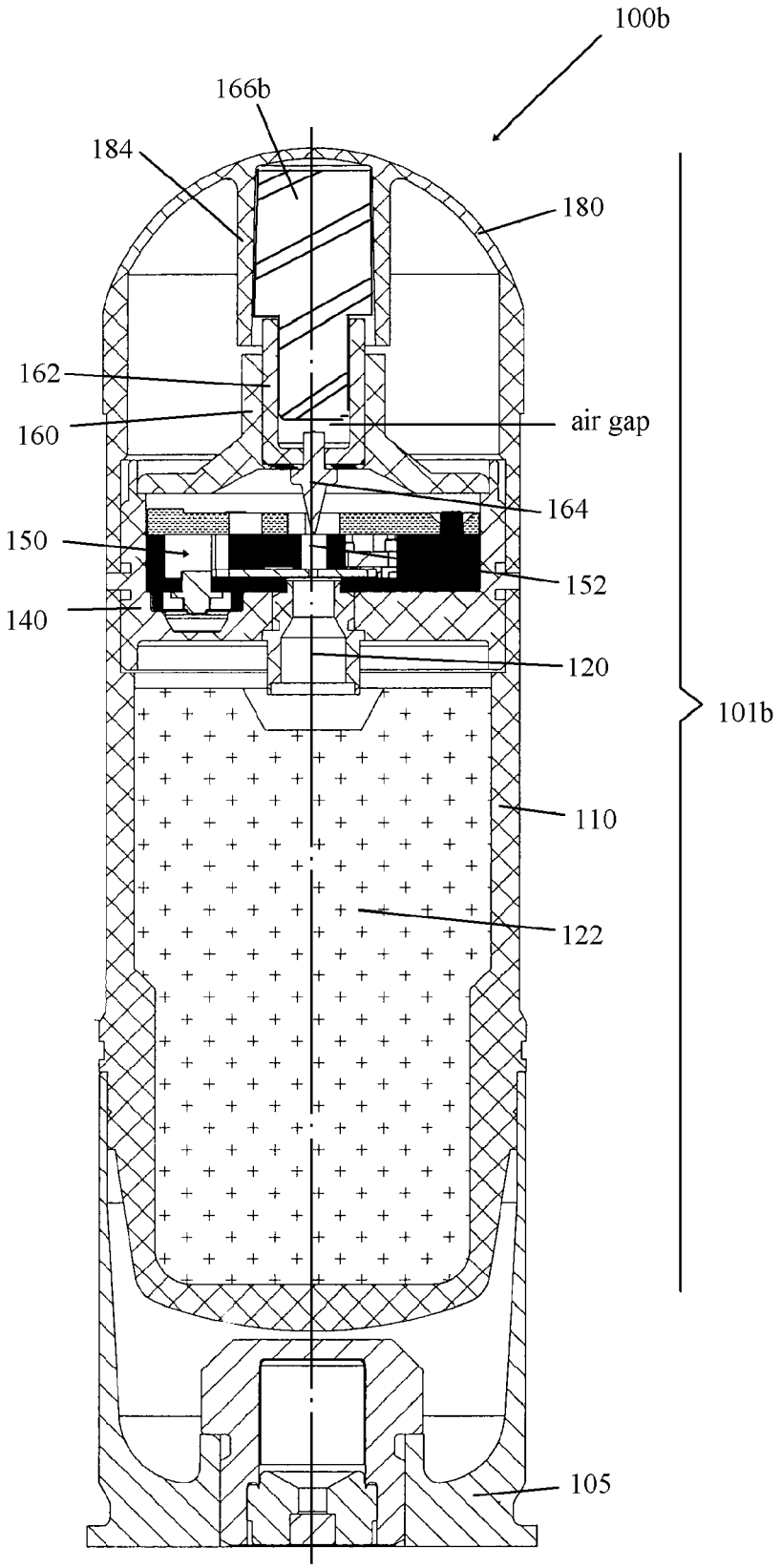
FIG. 2C illustrates a door breaching projectile/grenade according to another embodiment.

FIG. 2C shows a door breaching grenade 100*b* according to another embodiment. An ogive 180 of the door breaching grenade 100*b* has a hollow guide member 184 which is integrally formed to extend from an inside tip surface of the ogive 180; the hollow guide member 184 has a longitudinal axis that is co-axial with the longitudinal axis of the projectile 101*b*. Disposed inside the hollow guide member 184 is a plunger 166*b*; as in the above embodiment, a proximal end of the plunger 166*b* is disposed to slide in a sleeve 162, with the sleeve 162 being located in a seat member 160. As seen from FIG. 2C, an air gap is provided between the end of the plunger 166*b* and the detonator pin 164 for safe mechanical handling of the grenade 100*b*. The hollow guide member 184 allows a component of an oblique impact force at the ogive to transfer effectively along the plunger 166*b* to actuate the detonator pin 164.

Figure 2D:
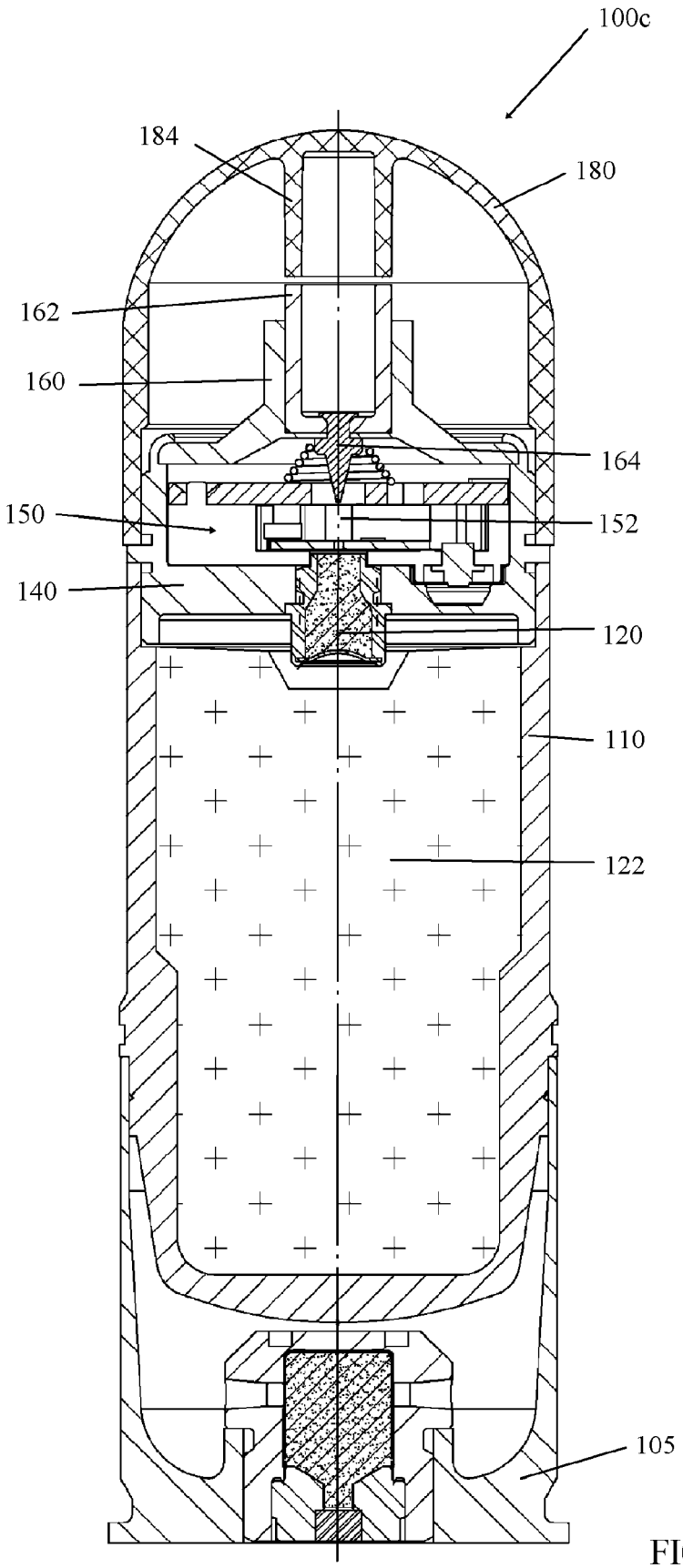
FIG. 2D illustrates a door breaching projectile according another embodiment.

FIG. 2D shows a door breaching grenade 100*c* according to another embodiment of the present invention. The door breaching grenade 100*c* shown in FIG. 2D is a variation of the embodiment shown in FIG. 2C. As seen in FIG. 2D, the hollow guide member 184 is integrally molded to extend from an inside surface of the ogive 180 at the forward tip, with both outside and inside diameters substantially similar to those of the sleeve 162. When assembled, the hollow guide member 184 is longitudinally aligned with the sleeve 162, preferably with a small air gap in between. In another embodiment, there is no substantial air gap between the hollow guide member 184 and the sleeve 162. It is possible that in another embodiment, a plunger is disposed inside the hollow guide member 184 and the sleeve 162, with the plunger to assist transfer of impact force on the ogive to the detonator pin 164.

Figure 2E:
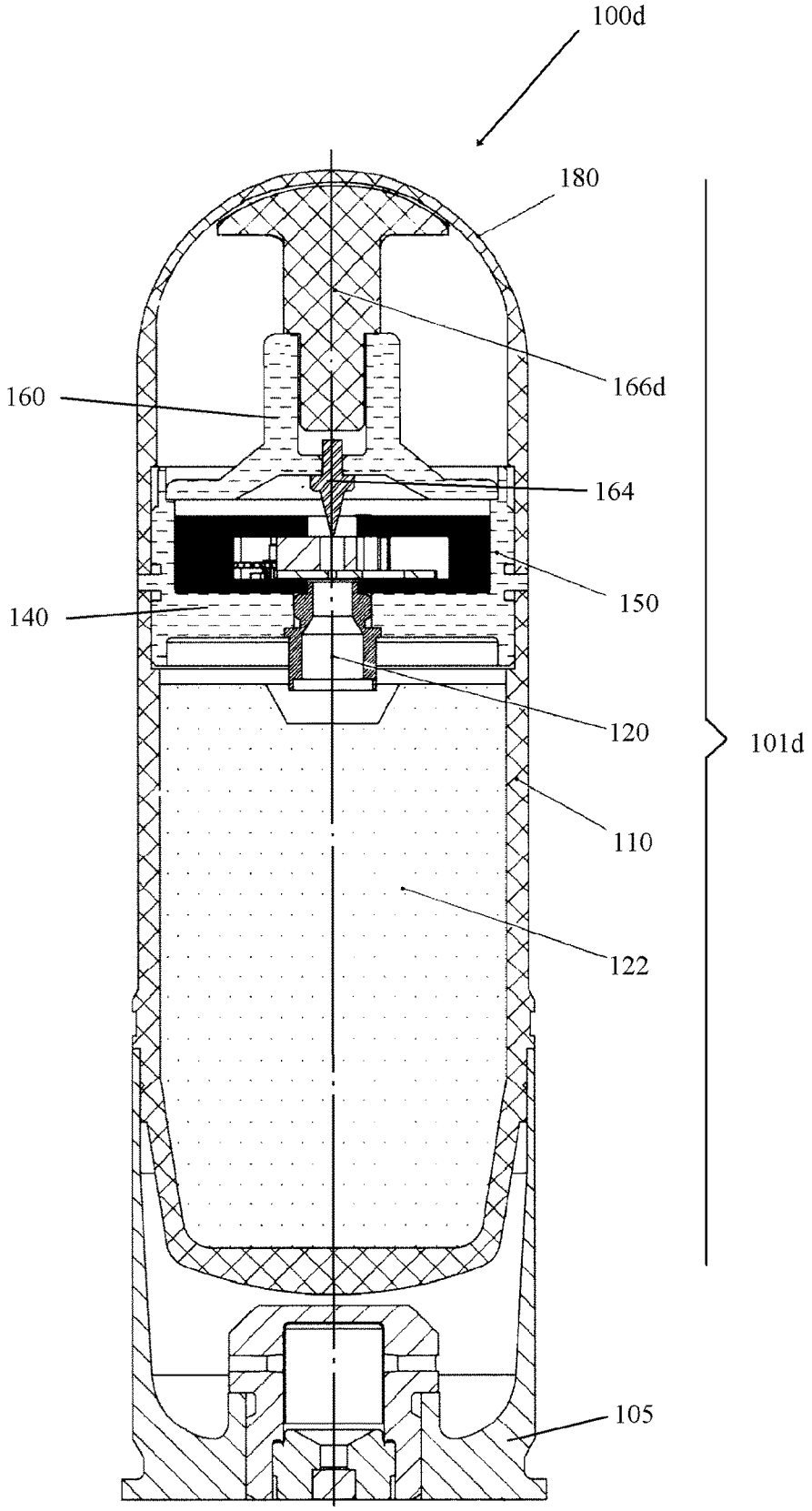
FIG. 2E illustrates a door breaching projectile with a mushroom head plunger according to yet another embodiment.

FIG. 2E shows a door breaching grenade 100*d* according to yet another embodiment of the present invention. The door breaching grenade 100*d* shown in FIG. 2E is similar to that shown in FIG. 2A except that a leading end of the plunger 166*d* is now shaped with a mushroom head. This mushroom-head plunger 166*d* is provided to transfer effectively a component of an oblique impact force at the ogive 180 along the plunger 166*d* to actuate the detonator pin 164 when the projectile 101*d* is put to such a use.

Figure 3:
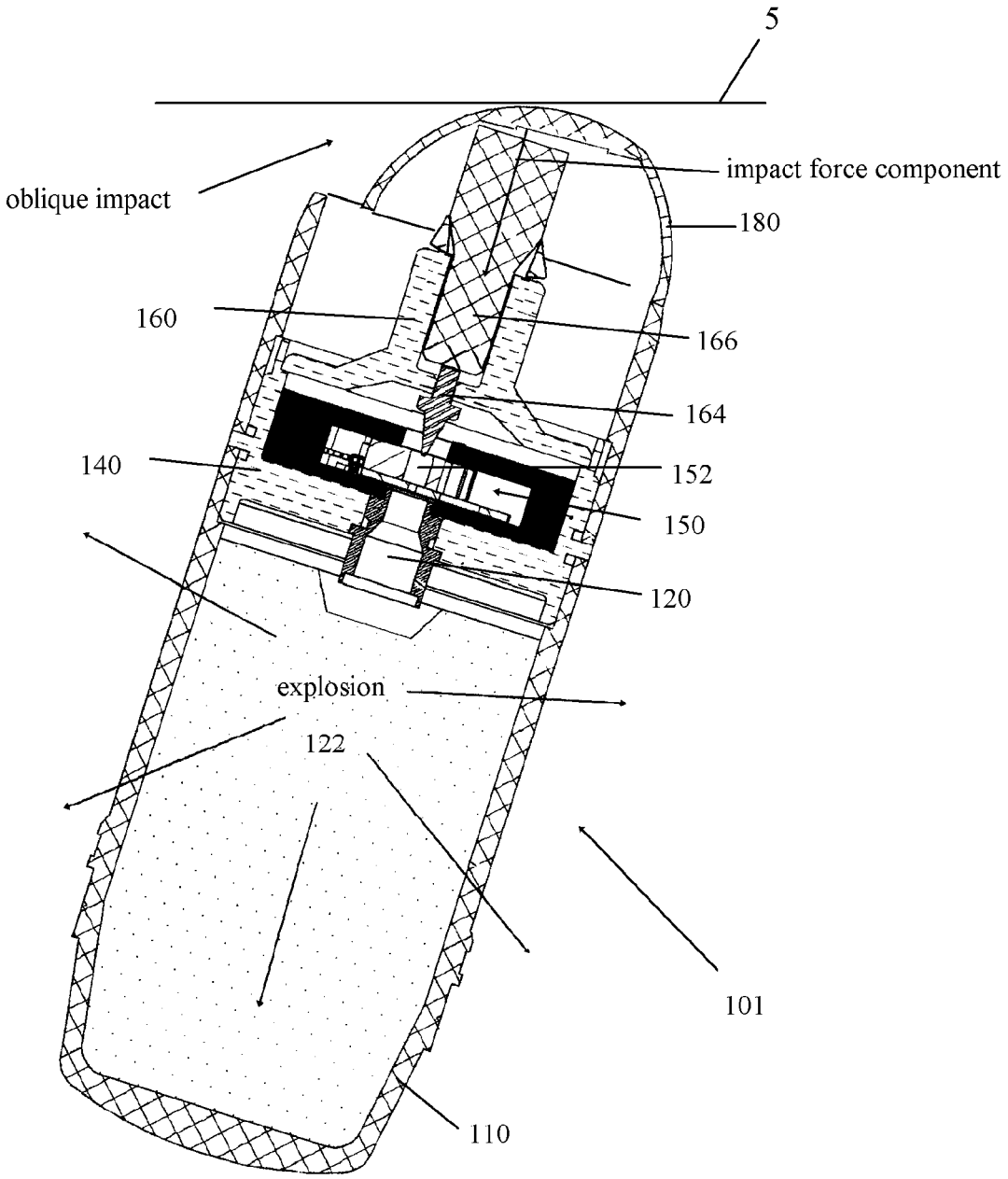
FIG. 3 illustrates an ogive of the above door breaching projectile fracturing, resulting in the plunger actuating a detonator pin, which then sets off a detonator charge, a booster charge and an explosive charge.

FIG. 3 shows the above door breaching projectile 101 impacting at an oblique angle on a door/barricade 5. Upon impact, the ogive 180 fractures along a thickness transition between the shaped ogive portion and the cylindrical portion. The fractured ogive becomes deformed in shape but the impact forces have a component that acts along the plunger 166. As a result, the plunger 166 is forced to slide into the seat member 160 and plunges/impinges onto the detonator pin 164. By this instant, the projectile 101 is already in the armed position and the detonator pin 164 is aligned with the detonator 152, which detonator 152 is also aligned with the booster charge 120. Actuation of the detonator pin 164 then sets off the detonator 152, booster 120 and explosive 122 charges, so that shock waves from the explosion force the door/barricade 5 to cave in, whilst the projectile 101 remains substantially outside the door/barricade. In this manner, injury to any occupant or destruction of property behind the door/barricade is limited. A complementary method of using the above projectile or grenade is thus provided.

While specific embodiments have been described and illustrated, it is understood that many changes, modifications, variations and combinations thereof could be made to the present invention without departing from the scope of the present invention. For example, the safe-and-arm mechanism can be adapted from Applicant's own disclosure in U.S. Pat. No. 9,163,916. It is also possible to incorporate an electric detonator (in place of the above stab detonator) and a piezo-electric sensor to set off the electric detonator under control of a lock-out circuit. It is also possible to allow an entire assembly of the safe-and-arm mechanism 150 to slide forward upon the projectile impacting on the door/barricade.

The invention claimed is:

1. A door breaching projectile comprising:

a shell containing an explosive charge;

an open end of the shell with a mouth being connected to a rear edge of a body member;

a hollow ogive with a mouth being connected to a forward edge of the body member;

a safe-and-arm mechanism disposed in the body member, which safe-and-arm mechanism delays alignment of a detonator pin with a detonator charge only after the door breaching projectile has been propelled over a safe distance from the launcher and has spin rotated through predetermined numbers of spin; and a plunger slidable in a seat member, with the seat member being mounted on a forward face associated with the forward edge of the body member;

wherein, upon the door breaching projectile impacting on a door or barricade, the plunger is forced into the seat member to impinge onto the detonator pin, which then sets off the detonator charge and explosive charge, such that explosive shock waves cause the door/barricade to cave in but the projectile remains substantially outside the door/barricade.

2. The projectile according to claim 1, further comprising a sleeve, with the sleeve being received in the seat member so that a common axis is coaxial with a longitudinal axis of the door breaching projectile, and the plunger is slidable inside the sleeve under influence of an impacting force.

3. The projectile according to claim 1, wherein a leading end of the plunger contacts an inside surface of the ogive near a forward tip.

4. The projectile according to claim 3, wherein the leading end of the plunger sits in a collar formed on the inside surface of the ogive.

5. The projectile according to claim 3, wherein the leading end of the plunger sits inside a hollow guide member which is integrally formed to extend from an inside tip surface of the ogive.

6. The projectile according to claim 3, wherein the leading end of the plunger is formed with a mushroom head.

7. A door breaching grenade comprising a projectile according to claim 1 with the projectile being coupled to a propulsion cartridge.

8. A door breaching projectile comprising:

a shell containing an explosive charge;

an open end of the shell with a mouth being connected to a rear edge of a body member;

a hollow ogive with a mouth being connected to a forward edge of a body member;

a safe-and-arm mechanism disposed in the body member, which safe-and-arm mechanism delays alignment of a detonator pin with a detonator charge only after the door breaching projectile has been propelled over a safe distance from an associated launcher and has spin rotated through predetermined numbers of spin;

a sleeve disposed to slide in a seat member, with the seat member being mounted on a forward face associated with the forward edge of the body member; and a hollow guide member extending from an inside surface near a forward end of the hollow ogive, with the hollow guide member being aligned with the sleeve;

wherein, upon the door breaching projectile impacting on a door or barricade, the sleeve is forced into the seat member to impinge onto the detonator pin, which then sets off the detonator charge and explosive charge, such that explosive shock waves cause the door/barricade to cave in but the projectile remains substantially outside the door/barricade.

9. A method for breaching a door or barricade from a distance comprising:

launching a projectile from a grenade launcher to impact on the door/barricade;

after the projectile is armed, delay rotating a safe-and-arm mechanism so that a detonator charge is aligned with a detonator pin fitted in a seat member, with the seat member being mounted on a forward face of a body member; and wherein, upon the projectile impacting on the door/barricade, impact force on the door/barricade impinges on the detonator pin to set off both the detonator charge and an explosive charge disposed aft of the body member, so that explosive shock waves cause the door/barricade to cave in whilst the projectile remains substantially outside the door/barricade.

10. A door breaching projectile comprising:

a shell containing an explosive charge;

an open end of the shell with a mouth being connected to a rear edge of a body member;

a hollow ogive with a mouth being connected to a forward edge of a body member;

a seat member mounted on a forward face associated with the forward edge of the body member;

a detonator pin being fitted near a centre of the seat member; and a spring urging an assembly of a safe-and-arm mechanism into the body member;

wherein the safe-and-arm mechanism delays alignment of the detonator pin with a detonator charge disposed in the safe-and-arm mechanism only after the door breaching projectile has been propelled over a safe distance from an associated launcher and has spin rotated through predetermined number of spin, so that, upon the door breaching projectile impacting on a door or barricade, the assembly of the safe-and-arm mechanism slides forward, resulting in the detonator pin impinging on the detonator charge and, in turn, setting off the explosive charge, such that explosive shock waves cause the door or barricade to cave in but the projectile remains substantially outside the door or barricade.

* * * * *